US007959740B2

(12) United States Patent
Chevallier

(10) Patent No.: US 7,959,740 B2
(45) Date of Patent: Jun. 14, 2011

(54) POLISHER SHUTTLE, AND A METHOD AND A POLISHER DEVICE MAKING USE THEREOF

(75) Inventor: Stephane Chevallier, Saint Soupplets (FR)

(73) Assignee: Tech Group Europe Limited, Dublin (IE)

( * ) Notice: Subject to any disclaimer, the term of this patent is extended or adjusted under 35 U.S.C. 154(b) by 645 days.

(21) Appl. No.: 12/031,663

(22) Filed: Feb. 14, 2008

(65) Prior Publication Data

US 2008/0200101 A1 Aug. 21, 2008

(30) Foreign Application Priority Data

Feb. 14, 2007 (FR) ..... 07 53259

(51) Int. Cl.
*B08B 9/04* (2006.01)
*B08B 9/055* (2006.01)

(52) U.S. Cl. ..... 134/8; 15/3.5; 15/3.51; 15/104.061; 15/104.062

(58) Field of Classification Search ..... 15/3.5, 15/3.51, 3.52, 104.05, 104.061, 104.062, 15/104.063, 104.16; 134/8; 451/27, 109, 451/547

See application file for complete search history.

(56) References Cited

U.S. PATENT DOCUMENTS

| | | | | | |
|---|---|---|---|---|---|
| 616,696 | A | * | 12/1898 | Cochran | 15/3.51 |
| 864,544 | A | * | 8/1907 | Kessler et al. | 15/104.061 |
| 1,547,440 | A | * | 7/1925 | Penn | 15/104.061 |
| 2,095,823 | A | * | 10/1937 | Marshall | 15/3.51 |
| 2,763,017 | A | * | 9/1956 | Redin | 15/104.061 |
| 3,857,132 | A | * | 12/1974 | Knapp et al. | 15/104.061 |
| 4,069,535 | A | * | 1/1978 | Cato | 15/104.061 |
| 4,083,074 | A | * | 4/1978 | Curtis | 15/104.061 |
| 5,964,004 | A | * | 10/1999 | Bean | 15/104.16 |
| 6,038,725 | A | * | 3/2000 | Knapp | 15/104.061 |
| 6,067,682 | A | * | 5/2000 | Rankin | 15/104.061 |
| 6,145,150 | A | * | 11/2000 | Knapp | 15/104.061 |
| 6,308,363 | B1 | * | 10/2001 | Lino et al. | 15/104.061 |
| 6,699,331 | B1 | * | 3/2004 | Kritzler | 134/8 |

FOREIGN PATENT DOCUMENTS

| | | | | |
|---|---|---|---|---|
| DE | 10 31 676 | B | | 6/1958 |
| DE | 27 43 585 | A1 | | 3/1979 |
| EP | 063024 | | * | 10/1982 |
| EP | 427538 | | * | 5/1991 |
| FR | 73 846 | E | | 9/1960 |
| FR | 2 270 057 | A1 | | 12/1975 |
| FR | 2769250 | | * | 4/1999 |
| GB | 2339876 | | * | 2/2000 |
| GB | 2348939 | | * | 10/2000 |
| JP | 51 003489 | A | | 1/1976 |
| JP | 55-125965 | A | | 9/1980 |
| JP | 02-262947 | A | | 10/1990 |
| JP | 07-266206 | A | | 10/1995 |

* cited by examiner

*Primary Examiner* — Mark Spisich
(74) *Attorney, Agent, or Firm* — Panitch Schwarze Belisario & Nadel LLP

(57) ABSTRACT

The polisher shuttle serves to polish the inside walls of cylindrical tubes, in particular tubes for medical use. It comprises radial projections that are flexible along the axial direction, suitable for polishing the inside walls of tubes merely by relative movement between the shuttle and the tube, the shuttle passing inside the tube. In a longitudinal section, the sections of the projections form a series of separate undulations that are long and thin in the radial direction. The polishing method made possible by the shuttle is particularly simple, since a single pass of the shuttle can suffice for performing polishing; the method is thus fast and easy to automate, e.g. in a polisher device of the invention.

21 Claims, 4 Drawing Sheets

POLISHER SHUTTLE, AND A METHOD AND A POLISHER DEVICE MAKING USE THEREOF

The present invention relates to polishing the inside walls of cylindrical tubes, in particular tubes for medical use.

BACKGROUND OF THE INVENTION

In the medical field, it can be necessary to ensure that an inner part slides properly inside an outer tube, i.e. to ensure sliding with a minimum of friction while nevertheless benefiting from minimum clearance between the inner part and the outer tube.

By way of non-limiting example, the inner part may be the piston of a syringe, with the outer tube constituting the body of the syringe, or the inner part may be an inner tube such as the body of the syringe that is mounted to slide relative to an outer tube for covering one end of the inner tube, in particular for covering the needle of the syringe so as to avoid injury to the person handling the syringe after an injection.

In order to make it easier for the inner part to slide in the outer tube, a lubricating agent is generally provided on their facing walls. Lubrication ensures that friction is kept down to a minimum.

Nevertheless, the lubricating agent as used in this way constitutes a foreign body, the presence of which is often problematic in medical applications. There therefore exists a need for another technical solution that makes it possible to improve the sliding of a tube or an inner part inside an outer tube without it being necessary to have recourse to an additional lubricating agent.

The parts concerned (inner part, outer tube) are parts made of plastics material in industrial manner and on a very large scale. Given the large number of parts to be produced, the looked-for technical solution must be simultaneously simple, inexpensive, and involve each part during a length of time that is short; the solution must also be suitable for integrating in an industrial production process that is highly automated with very high rates of throughput.

The invention seeks to remedy those drawbacks by proposing a simple and reliable way of polishing the inside walls of cylindrical tubes, in particular tubes for medical use.

OBJECTS AND SUMMARY OF THE INVENTION

For this purpose, in a first aspect, the invention provides a device for polishing the inside walls of cylindrical tubes, in particular tubes for medical use, comprising a handling system for enabling relative movement to be imparted between a shuttle and a tube for polishing in order to polish the inside wall of the tube, during which movement the shuttle passes through the tube from one end of the tube to the other;

said polisher shuttle presenting a longitudinal axis, and comprising radial projections that are axially flexible, being suitable for coming into contact with the inside wall of a tube for polishing when the shuttle is inside the tube, and such that in a longitudinal section the sections of said projections form a series of mutually separate undulations, the peak-to-peak height of the undulations being greater than the distance between two successive undulations.

The term "peak-to-peak height of the undulations" should be understood herein as being the difference in distance from the axis of the shuttle between a point situated on the tip of an undulation and a point situated at the bottom of a trough between two undulations.

When said relative movement is performed between such a shuttle and a tube for the purpose of polishing the tube, the projections on the shuttle rub against the inside wall of the tube. On coming into contact with the wall of the tube, the ends of these projections curve backwards a little relative to the direction of movement. By rubbing against the inside wall of the tube, they polish it. In practice, when the outer tube serves as a guide for passing an inner tube, it has been found that such a polishing shuttle can, in a single pass, divide the resistance of the outer tube to passage of the inner tube by four or even more.

In an advantageous embodiment, said device further comprises: tube-holder tooling suitable for holding a tube while it is being polished; and a system for delivering tubes for polishing and removing polished tubes; and also the relative movement between the shuttle and the tube for polishing is movement of the shuttle relative to the tube.

The device operates as follows:

- the delivery and removal system delivers a tube and puts it into place on the holder tooling;
- the handler system causes a shuttle to pass into the tube by moving along its longitudinal axis; and finally
- the delivery and removal system recovers the polished tube and transfers it towards the following station in the production line.

The invention also provides a shuttle presenting a longitudinal axis, the shuttle being for polishing the inside walls of cylindrical tubes, in particular tubes for medical use. The object of the invention is achieved by the fact that the shuttle comprises radial projections that are flexible in the longitudinal direction, being suitable for coming into contact with the inside wall of a tube for polishing when the shuttle is inside the tube, and such that in a longitudinal section the sections of said projections form a series of mutually separate undulations, with the peak-to-peak height of the undulations being greater than the distance between two successive undulations.

The use of such a shuttle makes it pointless to use lubricant and it satisfies industrial constraints.

Because of their relative height, the projections are long and thin in shape in the radial direction, thereby giving them a certain amount of flexibility in the axial direction. In general, the projections extend in a direction that is substantially radial. Nevertheless, depending on the type of polishing desired, the projections may also be inclined (in general inclined only slightly, e.g. by a few degrees) in the longitudinal direction, either forwards or rearwards.

As mentioned above, in a longitudinal section, the sections of the projections form undulations of height that is greater than the distance between two undulations. Advantageously, for increased effectiveness and flexibility, the peak-to-peak height of said undulations is greater than twice the distance between two successive undulations.

The material of the projections is selected as a function of the material of the tubes to be polished, and more particularly as a function of the hardness of the inside walls thereof. The projection material is selected to be sufficiently flexible to avoid scratching the inside walls of the tubes for polishing; furthermore, it needs to have good ability to withstand tearing in order to ensure that the shuttle is durable.

Advantageously, the projections are mainly made of a flexible composite material. The material may be a uniform thermoplastic or thermosetting material of structure that is continuous and not formed in the form of grains (projections made of a material including hard "polishing grains" embedded in a resin or a binder could also be used). The material of the projections is thus a single material and the projections remain simple to fabricate.

With projections based on a flexible composite material, the shuttle can serve to polish all types of tube made of plastics material, in particular out of thermoplastics such as polycarbonates, polyamides, polyethylene terephthalate (PET), etc. The shuttle may also be used for polishing the inside walls of tubes made of glass.

The invention also relates to a method of polishing the inside walls of cylindrical tubes, in particular tubes for medical use, which method is well suited to industrial constraints and makes it possible to avoid having recourse to a lubricating agent.

This object is achieved by the fact that the method of the invention comprises the following steps:

providing a shuttle presenting a longitudinal axis and including radial projections that are axially flexible and suitable for coming into contact with the inside wall of a tube for polishing when the shuttle is inside the tube, and such that in a longitudinal section the sections of said projections form a series of mutually separate undulations, the peak-to-peak height of said undulations being greater than the distance between two successive undulations; and polishing the inside wall of the tube by causing relative movement to take place between the shuttle and the tube for polishing, during which movement the shuttle passes from one end of said tube to the other through the tube.

As can be seen, the method is particularly simple and is readily automated. The relative displacement between the shuttle and the tube, with the projections of the shuttle in contact with the wall, suffices to polish the tube.

Advantageously, during said relative movement between the shuttle and the tube, the movement of the shuttle relative to the tube is a single go-and-return movement, e.g. for tubes that are closed at one end.

Advantageously, during said relative movement between the shuttle and the tube, the shuttle performs a single pass through the tube to be polished, entering the tube via one end and leaving it via an opposite end. The polishing method is then particularly simple.

This version of the method, with the shuttle passing in one direction only, is more particularly advantageous when the tube for polishing presents on its inner wall an edge that must not be blunted or dulled. This applies in particular to numerous tubes that present a shoulder for performing a non-return function, for ensuring that relative movement between the inner part and the outer tube is prevented in one direction. There is then a preferred direction for causing the shuttle to travel, since if it were to travel in the opposite direction it would run the risk of jamming against the shoulder and damaging it.

With such tubes, the method of the invention being implemented with the shuttle passing in the preferred direction only of the tube, it is possible to polish the tube in a manner that is extremely simple and fast but without blunting or damaging the edge of the shoulder.

BRIEF DESCRIPTION OF THE DRAWINGS

The invention can be better understood and its advantages appear better on reading the following detailed description of embodiments given as non-limiting examples. The description refers to the accompanying drawings, in which.

MORE DETAILED DESCRIPTION

Figure 1:
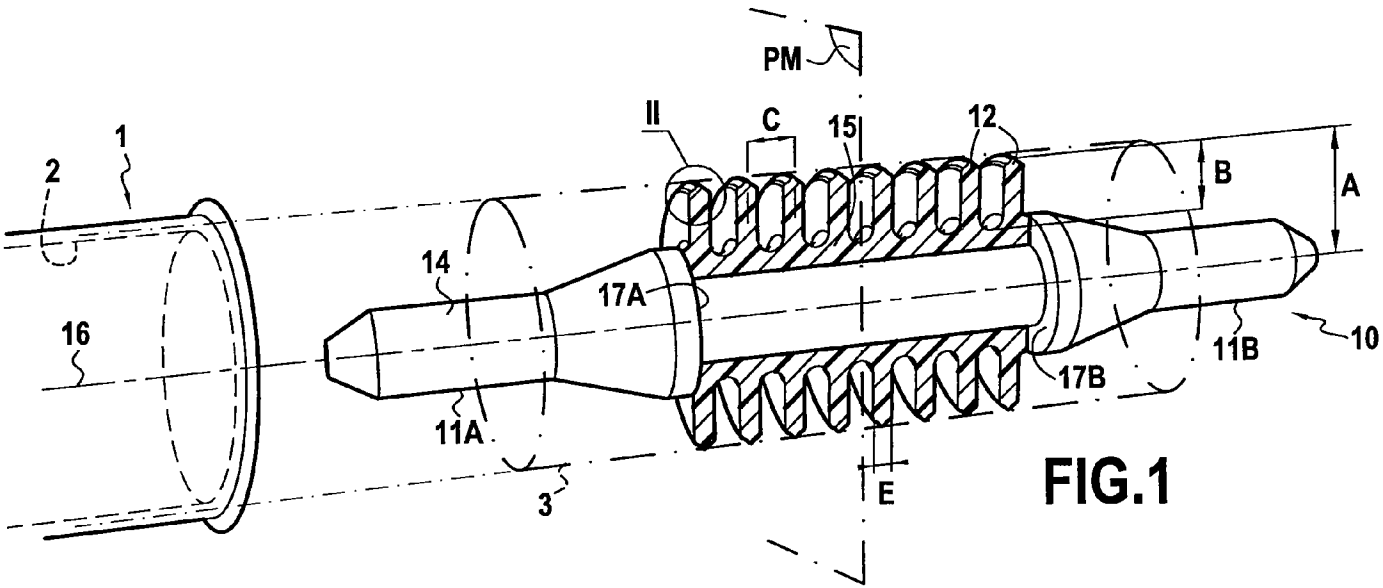
FIG. 1 is an axial section view of a polishing shuttle in accordance with the invention, in an embodiment in which the projections are in the form of disks.

With reference to FIG. 1, there follows a description of a shuttle.

The shuttle presents a longitudinal axis 16. Preferably it comprises a shaft 14 placed along the axis 16. It is thus made up of two portions: an inner shaft 14 that is generally made of metal or else of plastics material, extending along the longitudinal axis 16 which is also its movement axis; and a polisher part 15 made of plastics material.

The shaft 14 made of rigid material serves to hold and support the more flexible polisher part 15, and enables it to be handled.

In the embodiment shown, the polisher shuttle is in the form of a body of revolution; it is also symmetrical about its midplane PM perpendicular to its longitudinal axis. Because of this additional symmetry it can be used equally well for moving in one direction or in the opposite direction.

The shaft 14 is substantially in the form of a cylindrical bar. In its middle it presents a receiver portion in which the polisher part 15 is placed. This middle portion may be defined between two shoulders 17A and 17B serving to hold the polisher part axially on the shaft 15.

Advantageously, the increase in diameter at these shoulders is not too great, so as to enable the polisher part to be engaged on the shaft 14 by being passed over one of them. To do this, the polisher part may present a generally cylindrical through hole that extends along its axis and through which the shaft 14 passes.

Nevertheless, the part 15 may more generally be fitted on the shaft by any suitable means, in particular it may be formed by being overmolded thereon, which is equally compatible with shoulders that are more pronounced and with shoulders that are less pronounced, and even with the absence of any shoulders, in particular when an internal connection is provided between the shaft and the part 15, e.g. if they are made of compatible plastics materials.

In certain embodiments, in particular when the polisher part 15 is fitted onto the shaft 14, the shaft may be a reusable part while the polisher part, on the contrary, is a wear or consumable part.

Beyond the shoulders 17A and 17B there extend respective substantially cylindrical handle portions 11A and 11B. These handle portions make the polishing shuttle easier to handle for use in a polisher device. More generally, any form or structure that enables or facilitates handling of the shuttle could be used, whether it is to be pushed or pulled, and whether by mechanical means, by suction, or by other means.

The outside surface of the polisher part 15 has radial projections 12 suitable for coming into contact with the inside wall 2 of the tube 1 for polishing when the shuttle is inside the tube. For this purpose and for polishing, the projections are inscribed in a cylindrical envelope 3 of diameter that is slightly greater than the diameter of the inside wall of the tube for polishing.

It will be understood that the radius (A) of the polisher part, including the projections and measured from the axis 16 of the shuttle, must thus correspond substantially to the radius of the inside wall 2 of the tube 1 for polishing and must be slightly greater than said radius.

In the longitudinal section shown in FIG. 1, the sections of these projections form a series of mutually separate undulations. Furthermore, the peak-to-peak height (B) of these undulations is greater than the distance (C) between two successive undulations. The combination of these two characteristics makes the projections axially flexible, thus enabling them to be used for polishing operations.

Numerous embodiments are possible within the ambit of the invention.

Advantageously, and as shown in FIG. 1, the projections are substantially in the form of disks placed one after another along the longitudinal axis.

Figure 3:
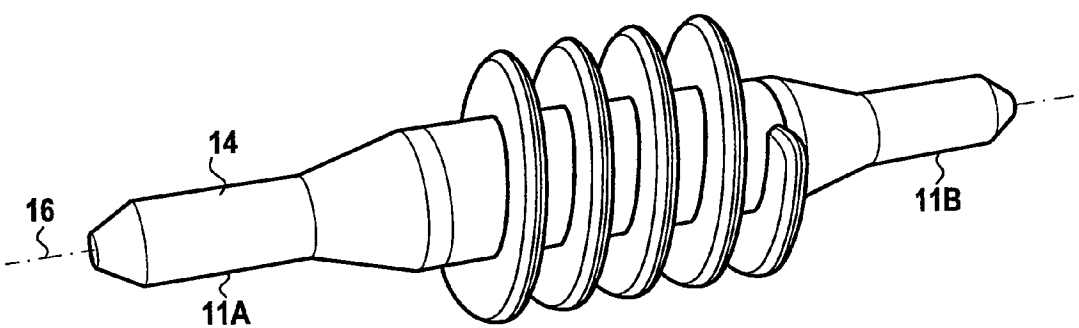
FIG. 3 is a perspective view of a shuttle in another embodiment of the invention in which the projections are in the form of a helix.

In another embodiment shown in FIG. 3, the projections are helical in shape.

In addition, for molding or other reasons, it is also possible for a projection, seen in a view looking along the axis of the shuttle, to extend over less than 360° about the axis, being subdivided or shared over one or more radial angular sectors. Under such circumstances, it is advantageous to ensure that the projections overlap axially the angular sectors left empty by other projections so that when considered as a whole, the projections do indeed cover 360°.

Finally, in a longitudinal section as shown in FIG. 1, the projections may be in the form of waves or they may have a profile that is substantially sinusoidal. The section width (E) of a projection may also be substantially constant or it may taper going away from the axis 16. Such a tapering profile for the section width (E) serves in particular to make it easier to fabricate polishing parts by injection molding by providing a degree of un-molding draft; it also imparts good strength to the polisher part 15.

Advantageously, in order to ensure good flexibility, the longitudinal section of the projections may present a mean or median section width (E) that is less than the peak-to-peak height (B) thereof, and even less than half said height.

As mentioned above, the shuttle may have a metal shaft lying on its axis. Advantageously, the projections 12 are overmolded onto said shaft 14 and the shaft is reusable. The projections generally constitute a single piece, which more particularly can be overmolded on the shaft 14. In another embodiment, the projections 12 together with the shaft 14 could constitute a single piece.

Figure 2:
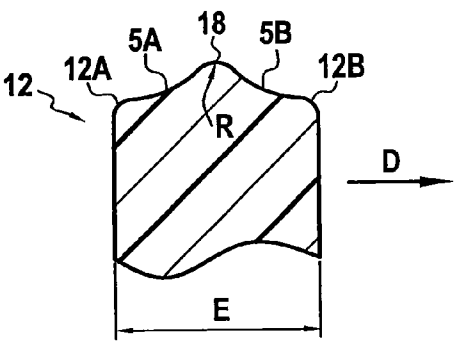
FIG. 2 is an axial section view showing a detail of the end of a projection of the polishing shuttle.

With reference to FIG. 2, the shape at the tips of the projections 12 is described below. The contact between the wall of the tube and the projections takes place substantially at the tips of the projections; the shape of this zone is therefore of importance.

Advantageously, in a longitudinal section of said projections, at least one point-contact zone 18 is to be found on at least one of said undulations and substantially at the tip thereof, said zone providing substantially point contact between the projections 12 and the tube for polishing (the term "tip" being used herein for an undulation to mean the portion of the undulation that is furthest from the longitudinal axis). It is made possible for the point-contact zone 18 to achieve almost point contact with the inside wall of the tube for polishing by ensuring that the radius of curvature R of the undulation, as measured in its longitudinal section, is small, in particular in comparison with the width E of the section of the projection.

Furthermore, advantageously in a longitudinal section of said projections, at least one of said undulations has substantially at the tip thereof at least two point-contact zones between the projection and the tube for polishing, these contact zones being separated by a concave zone. Thus, in FIG. 2, the projection section shown presents three such point-contact zones 12A, 12B, and 18 that are spaced apart by two concave zones 5A and 5B.

The advantage of such a shape is as follows:

When the shuttle passes along a tube, instead of having only one point of contact per projection, it can have two within a given section. The number of contact points of each projection is thus doubled.

From FIG. 2, it can be understood that when the projection moves in the direction of arrow D while in contact with the inside wall of the tube (assumed to be stationary), it curves slightly rearwards relative to the movement, i.e. in the opposite direction to the arrow D. The point-contact zones 12B and 18 are then both brought into contact with the wall of the tube, where they perform a polishing action. In contrast, while traveling in this direction, the point-contact zone 12A does not come into contact with the wall of the tube. Conversely, it comes into contact when the shuttle is passing along the tube in the direction opposite to the arrow D.

There follows a description of a polishing method given with reference to FIGS. 4A to 4D. This method uses the above-described shuttle.

In the method of the invention, the inside wall of the tube is to be polished by imparting relative movement between the shuttle and the tube for polishing, during which movement the shuttle passes along the tube from one end of said tube to the other.

For this purpose, prior to polishing the tube for polishing, the tube for polishing is held stationary. Relative movement is then established between the shuttle and the tube for polishing; this movement being movement of the shuttle relative to the tube. Finally, after the tube has been polished, the tube is released.

In order to hold the tube for polishing stationary, means are used, such as in particular tube-holding tooling 26. In the embodiment shown in FIG. 4A, a tube 24B is initially put into place by delivery and removal means (not shown). The tube 24B for polishing is held for polishing purposes in a holder passage 40 passing through the tooling 26 and opening out to both sides thereof 36A and 36B via two openings 36 and 38. The tube has a cylindrical portion with an inside cylindrical wall that is to be polished, and a flared neck forming a shoulder at one end 32 of the cylindrical portion. The tube 24B is held in the holder passage 40, firstly by inserting the cylindrical portion into the holding passage, and then by bringing the above-mentioned shoulder of the tube into abutment against the side 36B of the tooling 26 so as to prevent the tube from engaging further into said holding passage 40 when the shuttle is moving in the tube in the direction represented by arrow F.

Figure 4A:
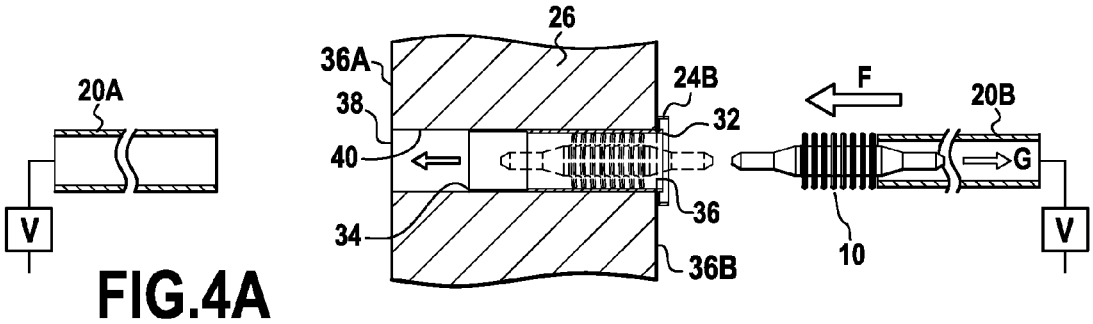
FIGS. 4A to 4D are diagrammatic views showing the polishing method of the invention.

FIG. 4A shows the beginning of the polishing step. The shuttle 10 is held by suction on the end of a pusher tool 20B, by virtue of the tool being evacuated or partially evacuated (arrow G) by suitable air suction and/or compression means (V).

Advantageously, in order to establish relative movement between the polisher shuttle and the outer tube, the polisher shuttle is caused to pass inside the tube by being pushed through it. Thus, the pusher tool 20B moves in translation in the direction of arrow F and pushes the shuttle through the tube 24B for polishing. In the embodiment shown, the shuttle passes once only into the tube 24B for polishing, moving solely in the direction represented by arrow F, i.e. from a first end 32 of the tube towards its second end 34.

The shuttle is thus caused to pass along the tube by being inserted via a first side 36B of the tooling and by subsequently being recovered from the other side 36A of the tooling. In the possible circumstance (not shown) of holder passages that are shorter than the tube for polishing, then the shuttle is recovered directly in the vicinity of the second end 34 of the tube.

The movement of the shuttle relative to the tube for polishing is thus a single stroke in translation. There is no need to make provision for rotation as well. Since the projections of the shuttle extend all around the circumference (360°) of the inside wall of the tube for polishing, when the shuttle passes inside the tube, the entire circumference of the inside wall of the tube is polished by a single pass of the shuttle moving in translation.

The tube 24B as polished in this way can then be extracted from the tooling 26 by being pulled in the direction opposite to arrow F, and then transferred to the remainder of the production line.

Figure 4B:
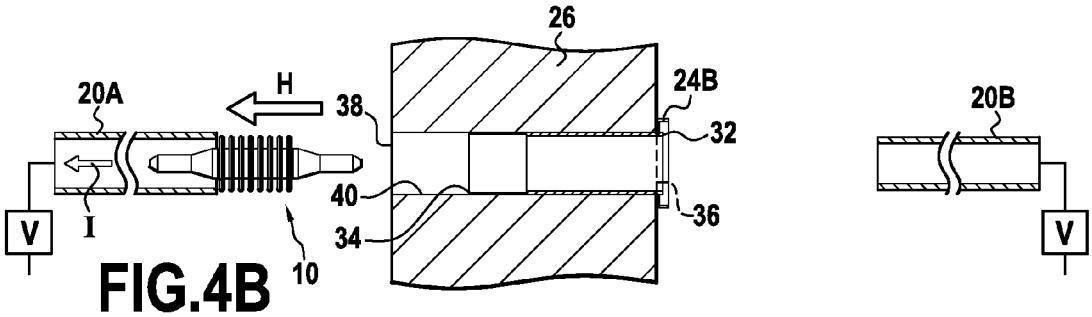

As shown in FIG. 4B, the polisher device has an air suction and/or compression system V connected to the pusher tool 20A and used for recovering shuttles after they have passed through the tubes (arrow I). To do this, the pusher tool 20A advances close to the opening in the side 36A of the holder passage, picks up the shuttle by suction, and then moves away from the tooling (arrow H).

When the air suction and/or compression system includes the air compression function, it can be used to subject the shuttle to air pressure (compressed air) that serves to propel it through the tube for polishing, e.g. during the step of the method shown in FIG. 4A for the purpose of propelling the shuttle 10 in the direction of arrow F towards the pusher tool 20A.

Furthermore, the tube delivery and removal system (not shown) removes the now-polished tube 24B by pulling in the direction opposite to arrow F, and also puts a new tube 24A for polishing into place from the side 36A of the tooling, the side on which the shuttle is located.

Figure 4C:
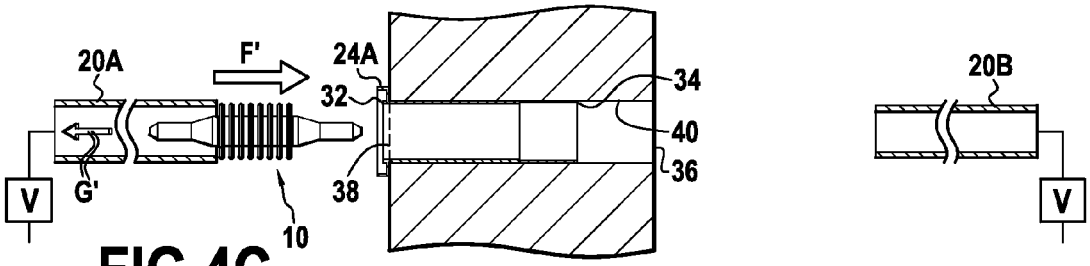

FIG. 4C then shows the beginning of polishing the tube 24A in a manner similar to step 4A. The shuttle is initially held in the pusher tube 20A by suction (arrow G'). The pusher tube 20A then advances in the direction represented by arrow F' to cause the shuttle to pass into the tube 24A through the holder passage.

Figure 4D:
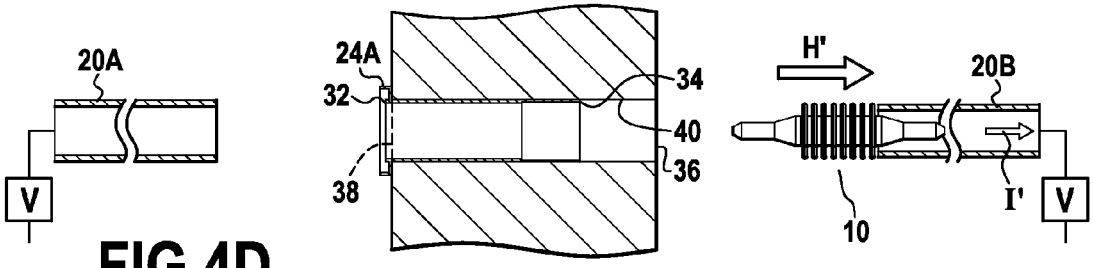

In the following step shown in FIG. 4D, the shuttle is picked up by the pusher tool 20B. The now-polished tube 24A can then be removed by the tube delivery and removal system (not shown) and transferred to stations located downstream in the production line.

In general, the polishing method is implemented in a polisher device having a plurality of holder passages similar to the holder passage 40, arranged within a common carousel or cylinder. As a result, the operations of putting tubes for polishing into place and for removing polished tubes can be performed both concurrently and without risk of collision between the shuttle-handling system and the system for delivering and removing a tube.

The description below of various embodiments of the polisher device of the invention shows more clearly the various advantages of the polishing method.

Figure 5:
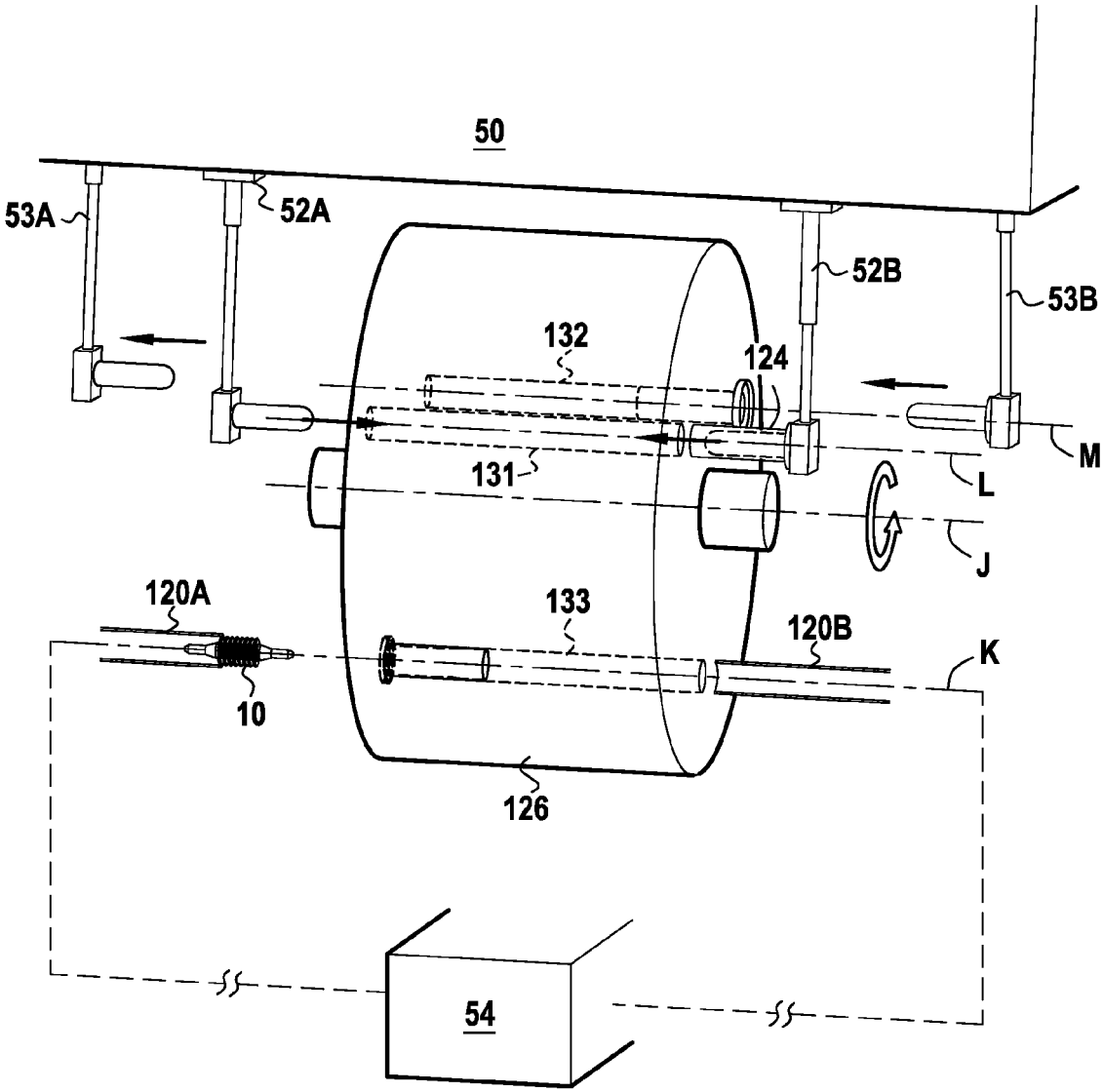
FIG. 5 is a diagrammatic view of a polisher device of the invention in a first embodiment in which the shuttle is movable relative to the tube for polishing.

With reference to FIG. 5, a polisher device of the invention is described below. This device serves to apply the above-described method to polish the inside walls of cylindrical tubes.

The polisher device thus comprises a holder tooling 126 for holding tubes while they are being polished, a delivery and removal system that, in the embodiment shown, comprises a system (52A, 53A; 52B, 53B) for delivering tubes for polishing and for removing polished tubes, and a shuttle-handler system comprising pusher tools 120A and 120B situated on either side of the tooling 126.

Advantageously, the tube-holder tooling 126 can be a carousel having holder passages passing therethrough, e.g. three passages 131, 132, and 133. The general shape of the carousel may optionally be generally cylindrical, depending on the number of tubes polished on each cycle. The carousel is rotatable about an axis J.

Each of the holder passages 131, 132, and 133 has open ends and is suitable for holding a tube for polishing, possessing a first end opening out to a first side of the tube-holder tooling and a second end opening out to the other side of the tooling.

The carousel turns about an axis under drive from a rotary drive system (not shown), e.g. under electrical or hydraulic power. In the example shown, the carousel needs to stop successively in three positions, in which the holder passages 131, 132, and 133 are in alignment respectively with axes K, L, and M, in order to perform respectively the operations of putting a tube for polishing into place, of polishing the tube, and of removing the polished tube.

On the axis K, which is the travel axis of the polisher shuttle, there can be seen on either side of the tooling 126 the pusher tubes 120A and 120B. These serve to push the shuttle 10 through the tube for polishing, applying the above-described method. They are evacuated by a vacuum system 54 creating suction that enables the shuttles to be secured to and retained on the ends of the pusher tool.

During a fabrication cycle:

In the holder passage situated to the right of the pusher tools 120A and 120B (on the axis K), the tube that is present is polished by passing the shuttle pushed by the pusher tool from a first side towards a second side of the tooling, the shuttle 10 then being picked up by the pusher tool situated on the second side;

- in the holder passage situated in register with the delivery system (on the axis L), a tube for polishing is inserted into the passage through the opening thereof that is situated on the second side, via a delivery channel 52A or 52B;
- in the holder passage situated in register with the removal system on the axis M, the previously-polished tube is removed and transferred to the following station in the production line via of the removal channels 53A or 53B; and
- once these operations have been performed, the carousel turns through 120° about its axis J.

The cycle can then begin again.

In the fabrication step shown in FIG. 5, a tube 124 is about to be put into place in the passage 131, the tube occupying the passage 133 is about to be polished, and the tube that has been polished and that is still held in the holder passage 132 is about to be removed by the removal channel 53B.

The holder tooling of a polisher device of the invention can be made in the form of a carousel or a cylinder and it can be made in various ways. For example, it could have six holder passages.

Advantageously, each holder passage can be used in both directions for tube polishing, the second opening then being used as the first, and vice versa.

When the shuttle passes in one direction only through a tube for polishing, the polisher device of the invention is particularly efficient. In a device as shown in FIG. 5, each holder passage is used in succession in opposite directions for polishing successive tubes, the tubes for polishing being fastened in succession to each of the two sides of the holder tooling 126, and the shuttle traveling alternately in each direction, polishing a tube on each pass.

Furthermore, in the example shown in FIG. 5, the system used for handling the shuttles is a pusher tool co-operating with the handle portions situated at the ends of the shuttle. Naturally, the shuttle can adopt other shapes enabling it to be handled (it may have holes, projections, or a system of co-operating shapes), and other mechanical handling techniques can be adopted, in particular involving pulling, possibly in combination with imparting rotation.

Furthermore, the shuttle can be moved relative to the tube either by using air under pressure or by using suction, possibly in combination with a mechanical pushing and/or pulling action, as mentioned above.

In another embodiment of the invention, instead of providing for the tube to be held stationary, with the shuttle traveling relative to the tube during the polishing step, the configuration can be inverted, i.e. during this step it is the tube that moves relative to the shuttle in order to perform polishing.

Under such circumstances, prior to polishing the tube for polishing, a polishing shuttle is held stationary; the relative movement between the shuttle and the tube for polishing is constituted by the tube moving relative to the shuttle; after the tube has been polished, it is released.

Figure 6:
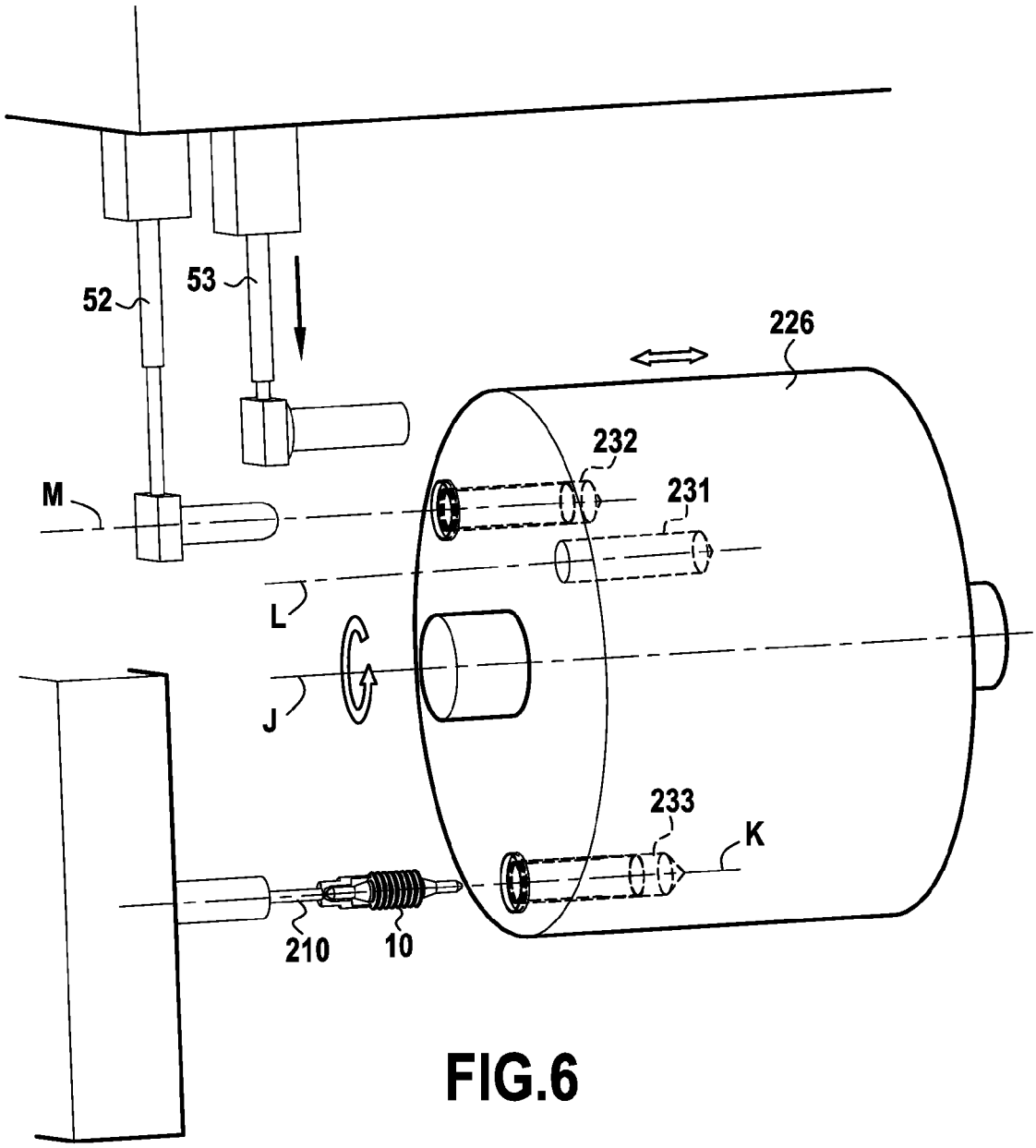
FIG. 6 is a diagrammatic view of a polisher device of the invention in a second embodiment in which the tube for polishing is movable relative to the shuttle.

Such a polisher device is described below with reference to FIG. 6. It comprises shuttle holder tooling 226 suitable for holding a shuttle during a polishing operation and the holder system comprises a system (52, 53, 226) for delivering tubes for polishing and for removing polished tubes, and it is suitable for moving a tube relative to the shuttle in order to perform the polishing operation, said relative movement between the shuttle and the tube for polishing being movement of the tube relative to the shuttle.

The tube delivery and removal system thus comprises a tube delivery channel 52, a tube removal channel 53, and tooling 226 for holding and moving tubes, which tooling has holder passages 231, 232, 233 constituted by blind cylindrical holes in the example shown.

The device is operated as follows. During each fabrication cycle, under drive from rectilinear and rotary drive means (not shown), the tooling 226 travels back-and-forth along the axis J, during which:

- the delivery channel puts a tube for polishing into place in the tube-holder passage in alignment with the axis M of the tube delivery channel 52;
- the tube present in the tube-holder passage in alignment with the shuttle axis K is polished by the tube moving relative to the shuttle; and
- the tube removal channel 53 removes the tube that has been polished from the tube-holder passage in alignment with the axis L of the tube removal channel 53.

After these operations, the tooling 226 turns through 120° about its axis of rotation J.

The shuttle is thus stationary on the holder tooling 226, while the tube for polishing within the moving tooling 226 moves relative to the shuttle in such a manner as to enable its inside wall to be polished. The advantage of the device shown in this figure is that it enables tubes that are closed at one end to be polished, unlike the device shown in FIG. 5.

Finally, it should be observed that the invention can also be used for polishing walls that include openings, in particular slots, e.g. axial slots, shoulders, etc., providing the shape thereof does not prevent the shuttle from passing. The invention can also be used not for polishing the entire length of the tube, but for polishing a fraction only of said length.

What is claimed is:

1. A shuttle presenting a longitudinal axis, the shuttle being for polishing the inside walls of cylindrical tubes, in particular tubes for medical use, the shuttle comprising radial projections that are flexible in the longitudinal direction and suitable for coming into contact with the inside wall of a tube for polishing when the shuttle is inside the tube, wherein in a longitudinal section, the sections of said projections form a series of mutually separate undulations, with the peak-to-peak height of the undulations being greater than the distance between two successive undulations, and wherein in the longitudinal section of said projections, at least two point-contact zones appear on at least one of said undulations and substantially at the tip thereof for providing contact between the projection and the tube for polishing, the contact zones being separated by a concave zone.

2. A shuttle according to claim 1, wherein the peak-to-peak height of said undulations is greater than twice the distance between two successive undulations.

3. A shuttle according to claim 1, wherein the projections are substantially in the form of disks placed one after another along the longitudinal axis.

4. A shuttle according to claim 1, wherein the projections are of helical shape.

5. A shuttle according to claim 1, wherein the projections are mainly made of a flexible composite material.

6. A shuttle according to claim 1, further comprising a shaft disposed along said longitudinal axis.

7. A shuttle according to claim 6, wherein the projections are overmolded on said shaft and that the shaft is reusable.

8. A method of polishing the inside walls of cylindrical tubes, in particular tubes for medical use, the method being characterized by the steps of:

providing a shuttle presenting a longitudinal axis and comprising radial projections that are axially flexible and suitable for coming into contact with the inside wall of a tube for polishing when the shuttle is inside the tube, and such that in a longitudinal section, the sections of said projections form a series of mutually separate undulations, the peak-to-peak height of said undulations being greater than the distance between two successive undulations;

holding the tube stationary prior to polishing, the relative movement between the shuttle and the tube for polishing being movement of the shuttle relative to the tube;

holding the tube for polishing in a holder passage pierced through a tooling and opening out to two sides of the tooling;

polishing the inside wall of the tube by causing relative movement to take place between the shuttle and the tube for polishing, during which movement the shuttle passes through the tube from one end of said tube to the other by being introduced via one side of the tooling and then being picked up via the other side of the tooling; and releasing the tube after polishing.

9. A polishing method according to claim 8, wherein in the polisher shuttle, the projections are substantially in the form of disks disposed one after another along the longitudinal axis.

10. A polishing method according to claim 8, wherein during said relative movement between the shuttle and the tube, the shuttle makes a single pass through the tube for polishing, entering the tube via a first end and leaving it via an opposite end.

11. A polishing method according to claim 8, wherein the shuttle is picked up from said other side of the tooling by a suction system.

12. A polishing method according to claim 8, wherein relative movement between the shuttle and the tube comprises causing the polisher shuttle to pass into the tube by pushing it through the tube.

13. A device for polishing the inside walls of cylindrical tubes, in particular tubes for medical use, the device comprising a handling system for enabling relative movement to be imparted between a shuttle and a tube for polishing in order to polish the inside wall of the tube, during which movement the shuttle passes through the tube from one end of the tube to the other; said polisher shuttle presenting a longitudinal axis and including radial projections that are axially flexible and suitable for coming into contact with the inside wall of a tube for polishing when the shuttle is inside the tube, and such that in a longitudinal section, the sections of said projections form a series of mutually separate undulations, the peak-to-peak height of the undulations being greater than the distance between two successive undulations;

a tube-holder tooling suitable for holding a tube stationary while it is being polished; and a system for delivering tubes for polishing and removing polished tubes, wherein the relative movement between the shuttle and the tube for polishing is movement of the shuttle relative to the tube.

14. A device according to claim 13, wherein in the longitudinal section of said projections, at least one point-contact zone appears on at least one of said undulations substantially at the tip thereof and suitable for providing substantially point contact between the projection and the tube for polishing.

15. A device according to claim 13, wherein in the polishing shuttle, the projections are substantially in the form of disks placed one after another along the longitudinal axis.

16. A device according to claim 13, wherein the tube-holder tooling includes an open-ended holder passage suitable for holding a tube for polishing, said holder passage having a first opening that opens out in a first side of the tube-holder tooling and a second opening that opens out in a second side of the tooling.

17. A device according to claim 16, wherein said holder passage can be used in both directions for polishing a tube, the second opening then acting as the first opening, and vice versa.

18. A device according to claim 16, wherein said holder passage is used successively in both directions for polishing successive tubes, the tubes for polishing being fastened in succession to each of the two ends of the holder passage, and the shuttle traveling alternately in each direction, polishing a tube on each passage.

19. A device according to claim 16, wherein the tube-holder tooling comprises a carousel having said holder passage pierced therethrough.

20. A device according to claim 13, including a suction system for picking up shuttles after they have passed through a tube.

21. A device for polishing the inside walls of cylindrical tubes, in particular tubes for medical use, the device comprising:

a handling system for enabling relative movement to be imparted between a shuttle and a tube for polishing in order to polish the inside wall of the tube, during which movement the shuttle passes through the tube from one end of the tube to the other; said polisher shuttle presenting a longitudinal axis and including radial projections that are axially flexible and suitable for coming into contact with the inside wall of a tube for polishing when the shuttle is inside the tube, such that in a longitudinal section, the sections of said projections form a series of mutually separate undulations, the peak-to-peak height of the undulations being greater than the distance between two successive undulation; and a shuttle-holder tooling suitable for holding a shuttle during a polishing operation, wherein the handling system includes a system for delivering tubes for polishing and for removing polished tubes, and is suitable for moving the tube relative to the shuttle to perform the polishing operation, said relative movement between the shuttle and the tube for polishing being movement of the tube relative to the shuttle.

* * * * *